US008695913B2

(12) United States Patent
Cheng

(10) Patent No.: US 8,695,913 B2
(45) Date of Patent: Apr. 15, 2014

(54) EARPHONE CORD WINDER

(75) Inventor: Chin-Hung Cheng, Chino, CA (US)

(73) Assignee: Sky Tech Worldwide, Inc., Chino, CA (US)

( * ) Notice: Subject to any disclaimer, the term of this patent is extended or adjusted under 35 U.S.C. 154(b) by 251 days.

(21) Appl. No.: 13/305,822

(22) Filed: Nov. 29, 2011

(65) Prior Publication Data

US 2013/0134252 A1 May 30, 2013

(51) Int. Cl.
*B65H 75/44* (2006.01)

(52) U.S. Cl.
USPC ..... 242/400.1; 242/405.1; 242/388; 242/388.1

(58) Field of Classification Search
USPC ..... 242/405.1, 400.1, 404, 406, 388, 388.1, 242/388.5–388.6
See application file for complete search history.

(56) References Cited

U.S. PATENT DOCUMENTS 6,164,582 A * 12/2000 Vara ..... 242/395
6,434,249 B1 * 8/2002 Wei ..... 381/370
2002/0117571 A1 * 8/2002 Scott et al. ..... 242/388
2007/0023559 A1 * 2/2007 Scapillato et al. ..... 242/400.1
2010/0224714 A1 * 9/2010 Winther et al. ..... 242/400.1
2013/0020425 A1 * 1/2013 Grassi et al. ..... 242/388
2013/0114231 A1 * 5/2013 Cheng ..... 361/807
2013/0140394 A1 * 6/2013 Cheng ..... 242/400.1

* cited by examiner

*Primary Examiner* — Sang Kim

(74) *Attorney, Agent, or Firm* — Alan Kamrath; Kamrath IP Lawfirm, P.A.

(57) ABSTRACT

The earphone cord winder allows the cord of an earphone device to be wound thereto in order to prevent damage due to excessive bending. The earphone cord winder has a body, first, second, and third protrusions formed around the body at intervals forming an upper cord groove and a lower cord groove, two receiving slots recessed on a first surface of the body, a plug groove recessed on a second surface of the body, a middle groove connecting the opposite sides of the first protrusion, a remote control groove communicating with the upper cord groove, two first recessions communicating with the two receiving slots respectively, at least one second recession recessed on a side of the second protrusion, and at least one third recession recessed on a side of the third protrusion and communicating with the plug groove.

18 Claims, 7 Drawing Sheets

EARPHONE CORD WINDER

BACKGROUND OF THE INVENTION

1. Field of the Invention

The present invention relates to a device for receiving earphones and, especially, to an earphone cord winder.

2. Description of the Prior Art

An earphone device, which is rather commonly available, has two earpieces, a cord and a plug. The cord has two ends, with one end connected to the earpieces and the other end to the plug. When an earphone device is in use, the earpieces are fitted to the ears, and the plug is connected to a sound source socket of an electronic device, to covert the signals of the electronic device into sound to be output.

Modern earphone devices are more diverse in function and may further have a remote control on the cord for adjusting volume or selecting songs without operating the sound source device.

However, casually putting an earphone device, with its earpieces, cord, plug and remote control together, in a purse or a pocket results in excessive bending or folding of the cord, which may disrupt inner parts such as copper wires and which in turn leads to malfunction of the earphone device. Specifically, the portions where the cord is connected with the earpieces or the plug are the most susceptible to damage due to excessive bending or folding thereof. In addition, abrasion on the surface of the plug due to frequent contact with other objects may also cause damage thereto and may lead to malfunction of the earphone device.

To overcome the shortcomings, the present invention provides an earphone cord winder to mitigate or obviate the aforementioned problems.

SUMMARY OF THE INVENTION

The main objective of the invention is to provide an earphone cord winder for alleviating the problem owing to lack of convenience to prevent parts of an earphone device from being damaged.

The earphone cord winder in accordance with the present invention allows the cord of an earphone device to be wound thereto in order to prevent damage due to excessive bending. The earphone cord winder has a body, first, second, and third protrusions formed around the body at intervals forming an upper cord groove and a lower cord groove, two receiving slots recessed on a first surface of the body, a plug groove recessed on a second surface of the body, a middle groove connecting the opposite sides of the first protrusion, a remote control groove communicating with the upper cord groove, two first recessions communicating with the two receiving slots respectively, at least one second recession recessed on a side of the second protrusion, and at least one third recession recessed on a side of the third protrusion and communicating with the plug groove.

When the earphone cord winder of the present invention is in use, the receiving slots respectively receive the earpieces, allowing the cord connected thereto to go sequentially along the first recessions and the middle groove and be wound within the upper cord groove, to hold the remote control in the remote control groove. The rest of the cord is further received in the second recession and wound in the lower cord groove, so that the rest of the cord goes through the third recession and reaches the plug groove, where the plug is to be held. With the foregoing structure and functionality thereof, the earphone cord winder of the present invention neatly winds the cord of the earphone device as well as holds the earpieces, the remote control and the plug without exposing the same, which effectively prevents damage due to excessive bending and which protects parts such as the plug from suffering from abrasion against other objects.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
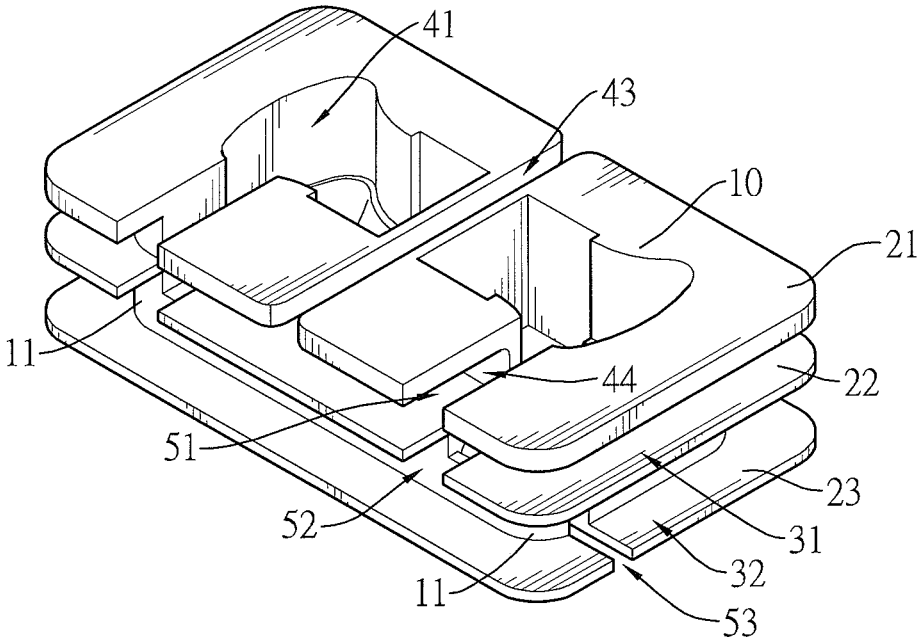
FIG. 1 is a perspective view of an earphone cord winder in accordance with the present invention.
Figure 2:
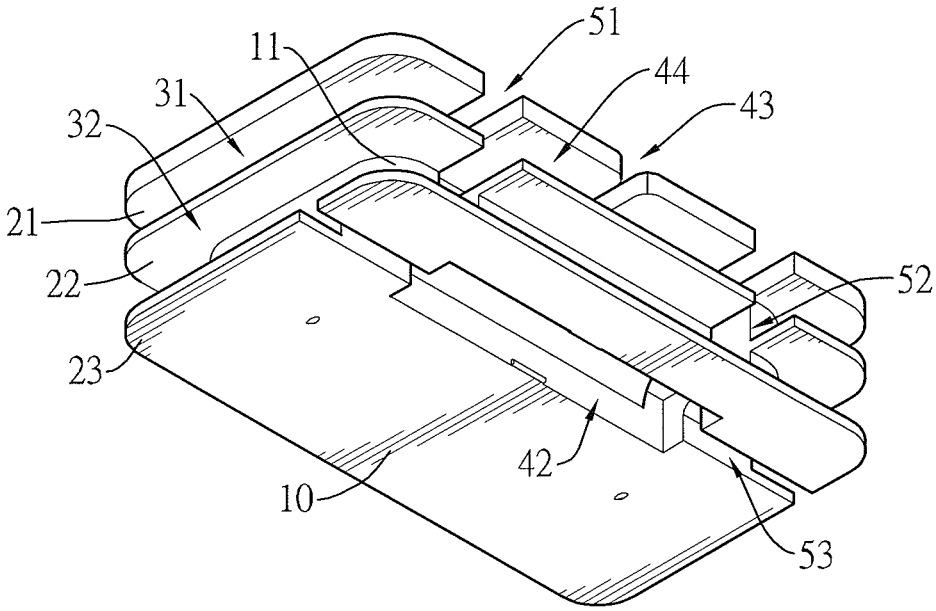
FIG. 2 is another perspective view of the earphone cord winder in FIG. 1.
Figure 3:
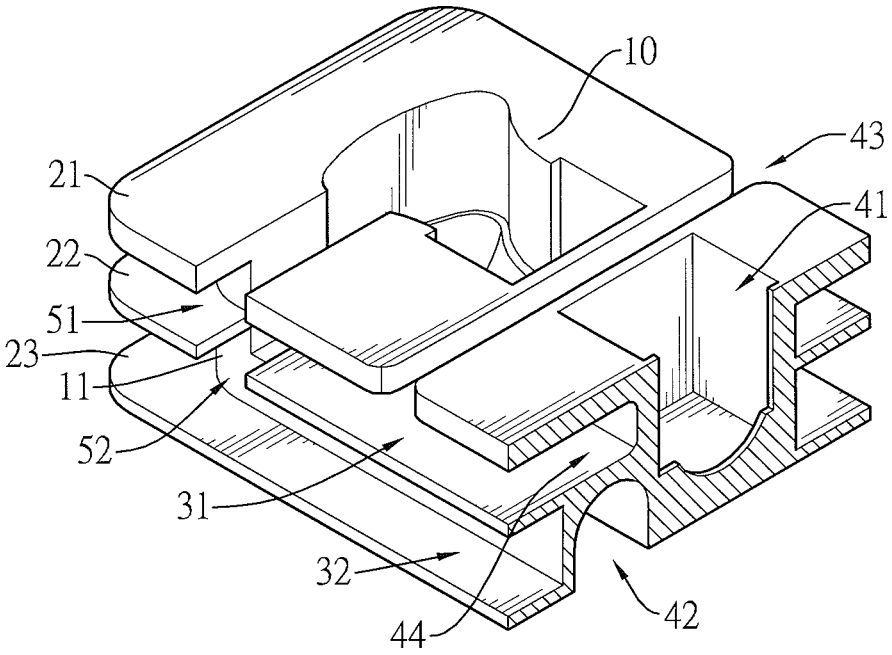
FIG. 3 is a perspective view of the earphone cord winder in partial section.
Figure 4:
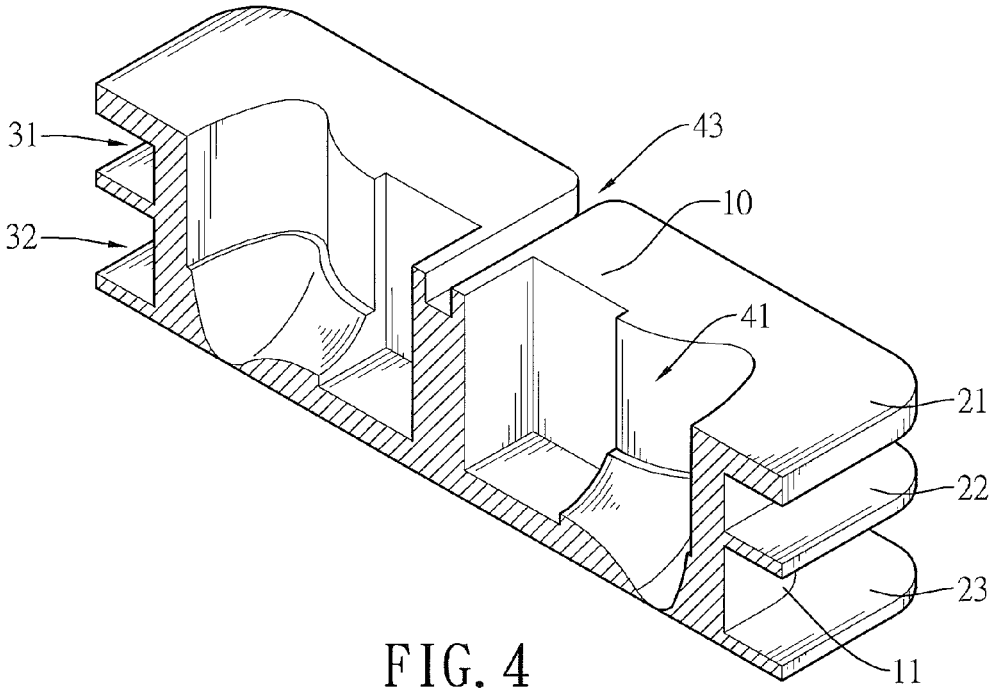
FIG. 4 is another perspective view of the earphone cord winder in partial section.

With reference to FIGS. 1 and 2, an earphone cord winder in accordance with the present invention comprises a body 10, a first protrusion 21, a second protrusion 22, a third protrusion 23, an upper cord groove 31, a lower cord groove 32, two receiving slots 41, a plug groove 42, a middle groove 43, a remote control groove 44, two first recessions 51, two second recessions 52, and two third recessions 53.

With reference to FIGS. 1 to 4, the body 10 is cubical and has a peripheral surface, a first surface, a second surface opposite to the first surface and four corners on the peripheral surface. The four corners on the peripheral surface of the body are rounded corners 11.

The first protrusion 21, the second protrusion 22 and the third protrusion 23 are formed around the peripheral surface of the body 10 and may protrude radially and horizontally outward at intervals. The second protrusion 22 is formed between the first protrusion 21 and the third protrusion 23. The first protrusion 21 is flush with a top surface, or a first surface, of the body 10, while the third protrusion 23 is flush with a bottom surface, or a second surface, of the body 10. The first protrusion 21, the second protrusion 22 and the third protrusion 23 are parallel with one another, and interval spaces are formed between the first protrusion 21, the second protrusion 22 and the third protrusion 23.

The upper cord groove 31 is formed among the body 10, the first protrusion 21 and the second protrusion 22.

The lower cord groove 32 is formed among the body 10, the second protrusion 22 and the third protrusion 23.

The two receiving slots 41 are recessed on the top surface of the body 10.

The plug groove 42 is recessed on the bottom surface of the body 10.

The middle groove 43 is recessed on the top surface of the body 10 between the two receiving slots 41 and connects the opposite sides of the first protrusion 21.

The remote control groove 44 is recessed on a front side of the peripheral surface of the body 10 and communicates with the upper cord groove 31.

The two first recessions 51 are separately recessed on a front side of the first protrusion 21 inwardly to the body 10 and communicate with the two receiving slots 41 respectively.

The two second recessions 52 are separately recessed on a front side of the second protrusion 22.

The two third recessions 53 are recessed on a front side of the third protrusion 23 inwardly to the body 10 and communicate with the plug groove 42.

Figure 5:
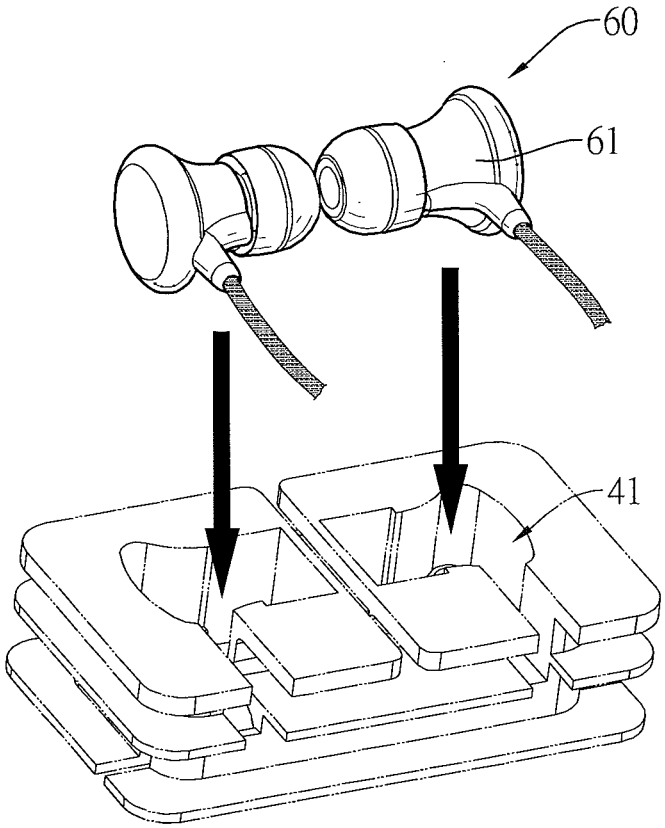
FIG. 5 is a first operational perspective view of the earphone cord winder in FIG. 1.

Using the earphone cord winder of the present invention may include the following steps:

Step 1: with reference to FIG. 5, holding the earpieces 61 of an earphone device 60 respectively in the receiving slots 41.

Figure 6:
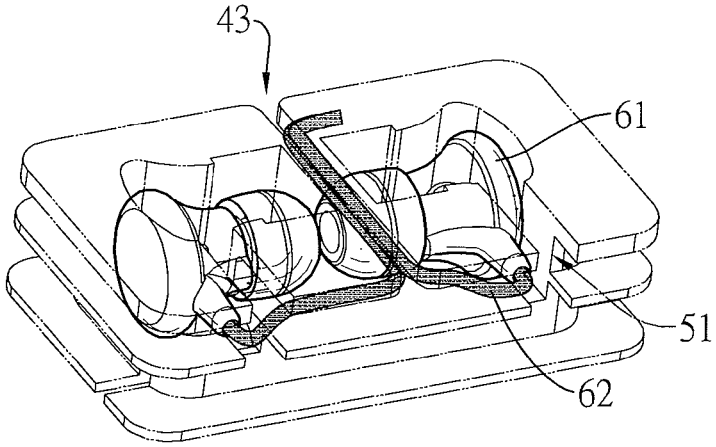
FIG. 6 is a second operational perspective view of the earphone cord winder in FIG. 1.

Step 2: with reference to FIG. 6, allowing the branches 62 forked from the cord to go sequentially along the two first recessions 51 respectively and then winding the same inwardly to join the branches 62 of the cord through the middle groove 43, from which the branches 62 are further wound backward.

Figure 7:
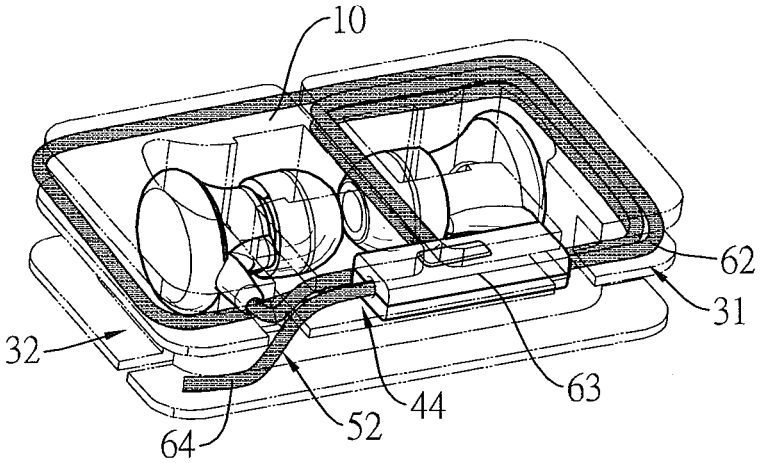
FIG. 7 is a third operational perspective view of the earphone cord winder in FIG. 1.

Step 3: with reference to FIG. 7, winding the branches 62, which are now joined, within the upper cord groove 31, to hold the remote control 63 in the remote control groove 44 located in a fore part of the body 10, and further winding a portion 64 of the cord between the remote control 63 and the end of the cord connected to the plug through the second recession 52 to the lower cord groove 32.

Figure 8:
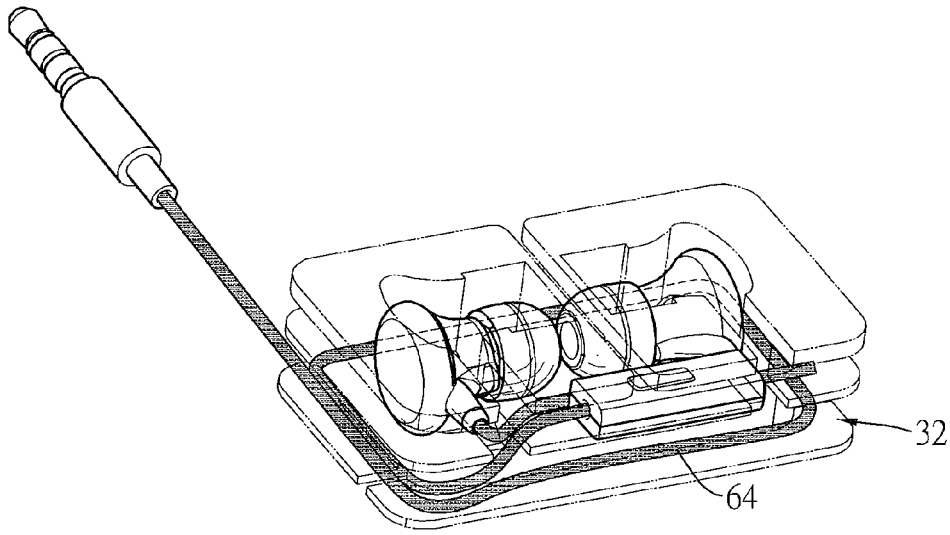
FIG. 8 is a fourth operational perspective view of the earphone cord winder in FIG. 1.

Step 4: with reference to FIG. 8, winding the portion 64 of the cord in the lower cord groove 32.

Figure 9:
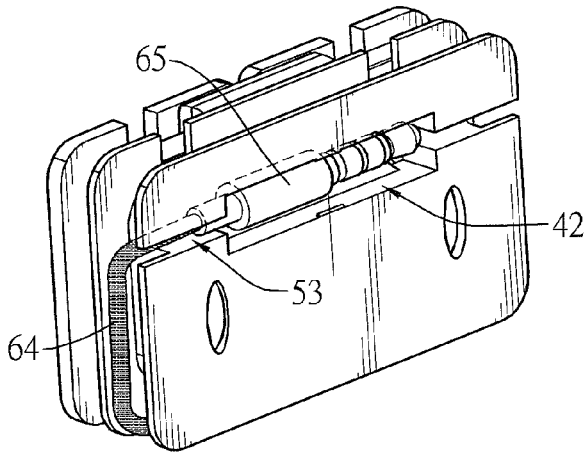
FIG. 9 is a fifth operational perspective view of the earphone cord winder in FIG. 1.

Step 5: with reference to FIG. 9, allowing the portion 64 of the cord to go through the third recession 53 and reach the plug groove 42 to hold the plug 65.

With the foregoing steps, the cord is neatly wound with the earphone cord winder of the present invention to prevent damage due to excessive bending. In addition, the earpieces, the remote control and the plug 65 are also accommodated within the earphone cord winder without being exposed to the outer environment, through which abrasion with other objects, and damage from such abrasion is prevented.

With reference to FIGS. 1, 2 and 7, the rounded corners 11 of the peripheral surface of the body 10 prevents the cord branches and portion 62, 64 from being damaged due to excessive bending when being wound within the upper cord groove 31 and the lower cord groove 32 along the rounded corners 11.

In other embodiments, the cord branches and portion 62, 64 may also be wound in a manner other than that shown in previous figures by switching to the other second recession 52 to hold the cord branches 62 downward to the lower cord groove 32, and switching to the other third recession 53 from which the cord portion 64 goes to the plug groove 42. Furthermore, forming two second recessions 52 and two third recessions 53 not only allows winding the cord portion 64 in a reversed direction, but also allows cord portions 64 of different lengths to go from any of the second recessions 52 to the lower cord groove 32 or to go from any of the third recessions 53 to the plug groove 42.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An earphone cord winder comprising:

a body having a peripheral surface, a first surface and a second surface opposite to the first surface;

a first protrusion formed around the peripheral surface of the body and having two sides opposite to each other;

a second protrusion formed around the peripheral surface of the body and having a side;

a third protrusion formed around the peripheral surface of the body and having a side, with the second protrusion between the first protrusion and the third protrusion, wherein interval spaces are formed between the first protrusion, the second protrusion and the third protrusion;

an upper cord groove formed among the body, the first protrusion and the second protrusion;

a lower cord groove formed among the body, the second protrusion and the third protrusion;

two receiving slots recessed on the first surface of the body;

a plug groove recessed on the second surface of the body;

a middle groove recessed on the first surface of the body between the two receiving slots and connecting the opposite sides of the first protrusion;

a remote control groove recessed on the peripheral surface of the body and communicating with the upper cord groove;

two first recessions recessed on one side of the first protrusion inwardly to the body and communicating with the two receiving slots respectively;

at least one second recession recessed on one side of the second protrusion; and at least one third recession recessed on one side of the third protrusion inwardly to the body and communicating with the plug groove.

2. The earphone cord winder as claimed in claim 1, wherein:

the body is cubical and has four corners on the peripheral surface;

the first surface and the second surface are formed on a top and a bottom of the body respectively; and the four corners on the peripheral surface of the body are rounded corners.

3. The earphone cord winder as claimed in claim 2, wherein the first protrusion, the second protrusion and the third protrusion are parallel with one another.

4. The earphone cord winder as claimed in claim 3, wherein the first protrusion, the second protrusion and the third protrusion are flush with one another.

5. The earphone cord winder as claimed in claim 4, wherein the two receiving slots are symmetrical.

6. The earphone cord winder as claimed in claim 5, wherein the at least one second recession comprises two second recessions.

7. The earphone cord winder as claimed in claim 6, wherein the at least one third recession comprises two third recessions.

8. The earphone cord winder as claimed in claim 2, wherein the first protrusion, the second protrusion and the third protrusion are flush with one another.

9. The earphone cord winder as claimed in claim 2, wherein the two receiving slots are symmetrical.

10. The earphone cord winder as claimed in claim 2, wherein the at least one second recession comprises two second recessions.

11. The earphone cord winder as claimed in claim 1, wherein the first protrusion, the second protrusion and the third protrusion are parallel with one another.

12. The earphone cord winder as claimed in claim 11, wherein the first protrusion, the second protrusion and the third protrusion are flush with one another.

13. The earphone cord winder as claimed in claim 12, wherein the two receiving slots are symmetrical.

14. The earphone cord winder as claimed in claim 13, wherein the at least one second recession comprises two second recessions.

15. The earphone cord winder as claimed in claim 14, wherein the at least one third recession comprises two third recessions.

16. The earphone cord winder as claimed in claim 1, wherein the first protrusion, the second protrusion and the third protrusion are flush with one another.

17. The earphone cord winder as claimed in claim 1, wherein the two receiving slots are symmetrical.

18. The earphone cord winder as claimed in claim 1, wherein the at least one second recession comprises two second recessions.

* * * * *